US005695395A

United States Patent [19]

Ota et al.

[11] Patent Number: 5,695,395

[45] Date of Patent: Dec. 9, 1997

[54] COIN DISPENSING APPARATUS

[75] Inventors: Michihiro Ota, Sakado; Masayuki Watabe; Yoshikazu Mori, both of Iruma-gun, all of Japan

[73] Assignee: Nippon Conlux Co., Ltd., Tokyo, Japan

[21] Appl. No.: 301,815

[22] Filed: Sep. 7, 1994

[30] Foreign Application Priority Data

| | | | |
|---|---|---|---|
| Sep. 7, 1993 | [JP] | Japan | 5-246151 |
| Oct. 29, 1993 | [JP] | Japan | 5-293933 |

[51] Int. Cl.[6] ..... G07D 1/00

[52] U.S. Cl. ..... 453/57; 221/203

[58] Field of Search ..... 453/32, 33, 49, 453/57; 221/203

[56] References Cited

U.S. PATENT DOCUMENTS

| | | | |
|---|---|---|---|
| 5,064,404 | 11/1991 | Champion | 453/57 X |
| 5,167,571 | 12/1992 | Waller | 453/57 X |

FOREIGN PATENT DOCUMENTS

| | | | |
|---|---|---|---|
| 2359466 | 2/1978 | France | 453/57 |
| 52-85895 | 7/1977 | Japan | G07D 1/00 |
| 53-51759 | 12/1978 | Japan | G07D 1/00 |
| 55-48634 | 12/1980 | Japan | G07D 1/00 |
| 56-145767 | 11/1981 | Japan | G07D 3/00 |
| 59-142689 | 8/1984 | Japan | G07D 1/00 |
| 59-191686 | 10/1984 | Japan | G07D 1/00 |
| 62-58392 | 3/1987 | Japan | G07D 1/00 |
| 63-36040 | 7/1988 | Japan | G07D 1/00 |
| 2-19882 | 5/1990 | Japan | G07D 1/00 |
| 2-67468 | 5/1990 | Japan | G07D 1/00 |

*Primary Examiner*—F. J. Bartuska
*Attorney, Agent, or Firm*—Koda and Androlia

[57] ABSTRACT

A coin dispensing apparatus having a simple construction and capable of dispensing coins securely and easily. A guide member is arranged extending along a tangent to a column formed in the center of rotation of the disk, whereby the coins can be smoothly transported along the guide member by means of a force from first protrusions without applying an impulsive force to the first protrusions and the guide member. Each coin transported to a predetermined position by the associated first protrusion is further transported to the outside of the transportation limit of the first protrusion by a second protrusion which is associated with a subsequent through hole, and is delivered securely to a coin dispensing port. A stirring rod having a rigid portion with an elliptic section and a rod with a circular section is fixed to the center of rotation of the disk, and the coins in a hopper are stirred by the protuberances on the outer peripheral surface of the rigid portion. Thus, extraordinary rotation of the disk and overloading of a motor, which may be caused by bridging or interference of the coins in the hopper, is prevented.

5 Claims, 15 Drawing Sheets

COIN DISPENSING APPARATUS

BACKGROUND OF THE INVENTION

1. Field of the Invention

The present invention relates to an improvement of a coin dispensing apparatus for use in a money changing machine, an automatic vending machine, or a game machine which utilizes dummy coins as game-use medals.

2. Description of the Related Art

In coin dispensing apparatuses, a disk having through holes is rotatably disposed between a hopper and a base, and coins are transported under pressure by protrusions formed on the surface of the disk which faces the base, whereby the coins are guided to a coin dispensing port on the base. Conventionally, there have been proposed various arrangements for the apparatuses of this type, including ones disclosed in Japanese Utility Model Publication No. 53-51759, Japanese Patent Publication Nos. 55-48634 and 63-36040.

In these proposed coin dispensing apparatuses, coins in the hopper are caught and guided one by one to the coin dispensing port as the disk rotates.

In the apparatus described in Japanese Utility Model Publication No. 53-51759, each coin is transported by a guide rib on the disk so that it abuts against a guide piece on the base, whereby the coin changes its course to be dispensed. The guide rib is located close to the center of the disk and the guide piece extends in the diametrical direction of the disk so as to approach an outer edge of the guide rib. Accordingly, a feeding force from the guide rib acts directly along the diameter of the coin abutting against the guide piece, so that the coin is sheared, as it were, in the diametrical direction by the guide rib and the guide piece. Thus, it is difficult to perform a high-speed dispensing operation as the rotation of the disk is hindered.

According to the apparatus described in Japanese Patent Publication No. 55-48634, a guide pin is situated so that coins do not get into the position where they may be sheared by the guide rib and the guide piece. In this case, however, every time a coin transported by the guide rib abuts against the guide pin and the guide piece, an impulsive force is applied to the guide rib, coin, and guide pin or guide piece. Thus, the rotation of the disk is hindered and the dispensing operation is not performed at a high speed. Moreover, the guide rib which cooperates with the guide piece to push out the coins from the disk, should be located near the center of the disk in consideration of its positional relation with the guide piece, so that its span is restricted considerably. Therefore, it is difficult to discharge each coin by the feeding action of the guide rib only, and about half body of the coin inevitably remains in the disk. All the coins in the hopper except the last one can be discharged entire from the disk by dispensing operation for the next coin. However, the last coin in the hopper is occasionally not discharged or dispensed, since it is followed by no other coin.

In the apparatus described in Japanese Patent Publication No. 63-36040, a scraper having a plurality of radially extending feed blades is pivotally mounted with its center of rotation outside the region of the disk. According to this arrangement, each coin transported under pressure to a predetermined position by the disk is scraped out by rotating the scraper in synchronism with the disk. Thus, the coins are securely dispensed to the last one. In this case, however, the apparatus has a complicated construction, and its various components move in a sophisticated manner, so that it is hard to speed up the dispensing operation satisfactorily.

In any of the coin dispensing apparatuses described above, the walls of the hopper are inclined so that the coins are guided to the disk which is disposed in a connecting portion between the hopper and the base. Therefore, the horizontal or cross-sectional area of the hopper becomes narrower with distance from the top. Since the coins are taken out one after another through the bottom portion of the hopper, a phenomenon of the so-called bridge of coins occurs, thereby forming a vacant space at the bottom of the hopper to cause a hindrance to coin dispensation. FIG. 10 shows an example of a bridge caused when a number of coins 4 regularly overlap one another, supported on walls 2 and 3 of a hopper 1. FIG. 11 shows an example of a bridge caused when a number of coins 4 irregularly overlap one another, supported on such portions of the walls 2 and 3 of the hopper 1 that are nearer to a connecting portion 5. In either case, the bridging phenomenon is caused as the coins 4 are taken out one after another through the connecting portion 5 at the bottom of the hopper 1.

In order to solve this problem, coin dispensing apparatuses proposed in Japanese Utility Model Publication No. 2-19882 and Japanese Utility Model Laid-Open Publication No. 56-145767 are designed so that the bridging is prevented by stirring the coins in the hopper.

In the apparatus described in Japanese Utility Model Publication No. 2-19882, a stirring rod with a spiral ridge formed thereon is provided extending along the axis of rotation of the disk. In this arrangement, a bridge of coins in the hopper is demolished by rotating the coin stirring rod to apply a vertical thrust to the coins around the rod by the spiral ridge. In the cases of FIGS. 10 and 11 where the numerous coins 4 in a substantially horizontal position overlap one another, the bridge can be removed relatively easily by hooking the outer peripheral portion of each coin 4 in contact with the stirring rod by means of the spiral ridge, thereby applying a vertical thrust to the coins 4. If the numerous coins 4 are arranged with their respective faces parallel to the central axis of a coin stirring rod 6, as shown in FIG. 12, however, the spiral ridge of the rod 6 can not engage the outer peripheral portion of each coin 4, so that the thrust is not transmitted. Thus, the regularly oriented state of the coins 4 is not ruined. Naturally, the same problem is also aroused when only one coin stands in sliding contact with the coin stirring rod 6 in a manner such that its face is parallel to the central axis of the rod 6, thereby keeping the other coins from touching the rod 6. Moreover., the same applies to the case where the outer peripheral portions of some of the coins are in sliding contact with the coin stirring rod 6 with their faces parallel to the central axis of the rod 6.

In the apparatus proposed in Japanese Utility Model Laid-Open Publication No. 56-145767, a bridge of coins is demolished extensively by a coin stirring rod which is bent like a crank. In this case, however, a bent portion of the stirring rod revolves eccentrically. If a number of coins 4 are arranged tightly between the coin stirring rod and an inner peripheral wall 5*a* of the connecting portion 5 at the bottom of the hopper, with their respective faces parallel to the central axis of the stirring rod, then the rotation of the stirring rod is possibly prevented, so that the disk is locked, as in the cases shown in FIGS. 13 and 14. In the example shown in FIG. 13, a columnar coin stirring rod 7 is located eccentrically to the axis of rotation of a disk 8. In the example shown in FIG. 14, a coin stirring rod 9 with a diametrical cross-sectional contour of a nonrotational body is located extending along the axis of rotation of the disk 8.

If the coin stirring rod is formed of a flexible material which is liable to elastically deform, a coin 4 may be elastically supported between the flexible stirring rod 10 and the inner peripheral wall 5a of the connecting portion 5 and prevented from falling into one of holes 11 in the disk 8 even when it is situated in a position such that it will otherwise fall smoothly into the hole 11, as shown in FIG. 15.

A bridge of coins, such as the ones shown in FIGS. 10 and 11, may be supported on three points, including the tip end of the coin stirring rod as well as the walls 2 and 3 of the hopper 1 (see FIGS. 16 and 17). Since the tip end of the stirring rod is provided with no stirring means, it can not remove the bridge. With use of the crank-shaped coin stirring rod, bridges of the types shown in FIGS. 16 and 17 are not produced. In this case, however, extensive revolution of the crank-shaped bent portion requires so high a torque that an excessive load acts on the disk and a motor for driving the stirring rod.

SUMMARY OF THE INVENTION

An object of the present invention is to provide a coin dispensing apparatus capable of performing coin dispensing operation securely and in a high speed with a simple construction and with less troubles.

Another object of the invention is to provide a coin dispensing apparatus, in which extraordinary rotation of a disk and overloading of a motor, which may be caused by bridging or interference of coins in a hopper, can be prevented, and coin dispensing operation can be performed smoothly.

A coin dispensing apparatus according to the present invention comprises a hopper for storing a number of coins, a base for supporting the hopper, a ring-shaped connecting member disposed between the hopper and the base and connected to a lower end portion of the hopper, and a disk rotatably disposed on the base in the connecting member. The disk has a plurality of through holes arranged at intervals on the circumference of one circle for catching the coins fed from the hopper, first and second protrusions arranged on either side of each through hole, and a column formed in the central portion of the disk. The disk rotates in the direction from the first protrusions to the second protrusions. The first and second protrusions and the column are formed on the surface of the disk which faces the base. The first protrusions are located in the vicinity of the outer peripheral edge of the disk, and the second protrusions are located a little closer to the outer peripheral edge of the disk than the first protrusions. The coin dispensing apparatus according to the invention further comprises a guide member provided on the base so as to extend along the rotating direction of the disk. The guide member has an abutment surface abutting the coins and has a length shorter than the distance from the outer peripheral surface of the column to each first protrusion. The abutment surface of the guide member extends along a tangent to the outer peripheral surface of the column from a position near the outer peripheral surface. An opening with a length greater than the diameter of each coin is formed in a peripheral wall of the connecting member so as to extend in the direction opposite to the rotating direction of the disk from a position on an extension of the abutment surface of the guide member. The base has a coin dispensing port bored therein along the opening.

As the disk rotates, the coins stored irregularly in the hopper are introduced one after another into the through holes. Each coin dropped onto the base through each through hole of the disk is transported under pressure by the associated first protrusion in a manner such that the path thereof is regulated by the associated second protrusion, the inner peripheral surface of the connecting member, and the outer peripheral surface of the column. When the coin transported by the first protrusion abuts against the guide member, it is held under pressure between the first protrusion and the guide member. This coin is subjected to a force substantially parallel to the guide member and directed from the inside of the disk to the outside, by vertical drags from the guide member and the first protrusion, and smoothly moves outward to the coin dispensing port.

Each first protrusion is situated in the direction opposite to the rotating direction of the disk with respect to each associated through hole, and the abutment surface of the guide member extends along a tangent to the column. Accordingly, the coin never fails to move from the inside of the disk to the outside, urged by the vertical drags from the first protrusion and the abutment surface.

The coin further moves outward along the abutment surface, threading through the gap between the first and second protrusions, and is delivered to a position near the outer periphery of the disk. As the disk further rotates, the second protrusion associated with the next through hole adjacent to the through which caught the coin presses the coin in the same manner as the first protrusion. Finally, the disk is entirely discharged, and is dispensed through the coin dispensing port on the extension of the guide member.

The coin dispensing apparatus according to the present invention further comprises a coin stirring rod projecting from the upper surface of the disk along the axis of rotation of the disk. The stirring rod includes a rod with a circular diametrical sectional contour, fixed to the disk and projecting above the upper edge of the connecting member, and a rigid portion fixed to the tip end of the rod and having a nonrotational configuration with a diameter greater than that of the rod.

A V-shaped through groove is formed in the upper end face of the rigid portion, whereby bridging can be removed with higher reliability.

As the rigid portion of the nonrotational configuration rotates integrally with the disk so that its relative protuberances stir the coins in contact with its outer peripheral surface, the coins stored in the hopper are caused to interact with one another to prevent the bridging.

DETAILED DESCRIPTION OF THE PREFERRED EMBODIMENTS

Figure 1:
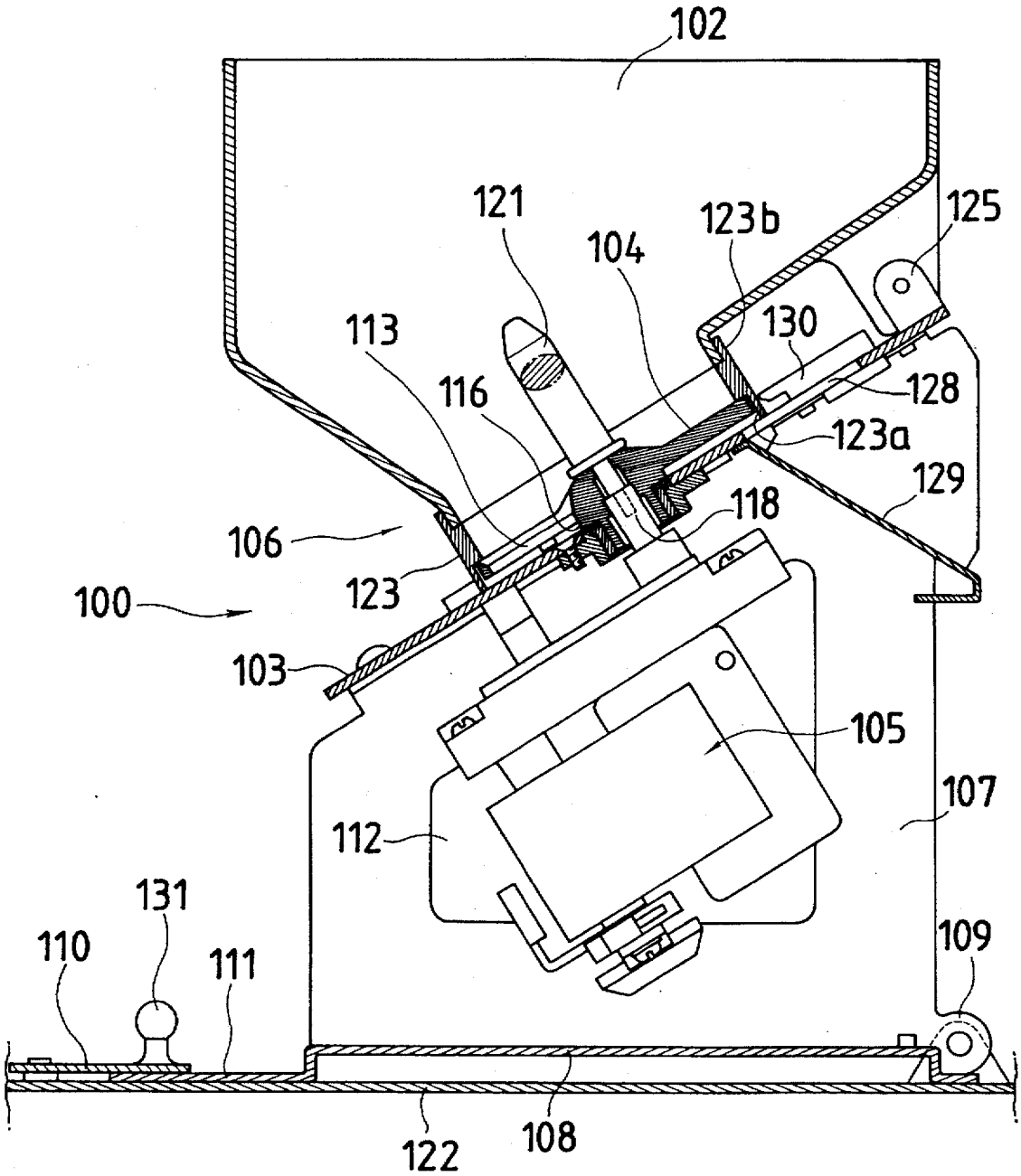
FIG. 1 is a side sectional view showing an arrangement of a coin dispensing apparatus according to one embodiment of the present invention.

Referring first to FIGS. 1 to 7, a first embodiment of the present invention will be described. As shown in FIG. 1, a coin dispensing apparatus 100 comprises a hopper 102 for storing coins, a base 103 for swingably supporting the hopper 102, a ring-shaped connecting member 123 connected to a bottom opening portion of the hopper 102, a disk 104 disposed in the connecting member 123, a disk drive unit 105 mounted on the lower surface of the base 103 for rotating the disk 104 by means of a geared motor or the like, and two side plates 107 for mounting a dispensing apparatus body 106, including these elements, in a housing of a money changing machine or automatic vending machine.

The two side plates 107 are disposed with the disk drive unit 105 between, and the upper and lower end portions of each plate 107 are fixed to the base 103 and a base plate 108, respectively. The coin dispensing apparatus 100 is pivotally mounted for swinging motion in the housing of the money changing machine or automatic vending machine by a pivot portion 109 provided at one end of the lower part of each side plate 107.

A tongue-shaped stopper member 110 is swingably mounted on a wall portion 122 of the housing in which the coin dispensing apparatus 100 is set, with a spacer which is as thick as the base plate 108. Thus, a lug 111 extending from the swinging-side end of the base plate 108 can be releasably retained.

In loading or replenishing coins in the hopper 102, or in performing maintenance operation for various parts of the dispensing apparatus body 106 including the disk drive unit 105, the stopper member 110 is swung to recede from the surface of the lug 111 by handling a knob 131 attached to the distal end of the member 110. Thereafter, the coin dispensing apparatus 100 is manually swung in the clockwise direction of FIG. 1 around the pivot portion 109 so that it can be held in a desired swinging angle position for ease of the aforesaid operation. Each side plate 107 has a wide viewing window 112 which is designed not to impair the necessary strength of the plate 107 which bears the load from the dispensing apparatus body 106 and the coins stored in the hopper 102. Through the window 112, therefore, the state of various components including the disk drive unit 105 can be checked, and tools can have easy access to the region under the base 103.

Figure 2A:
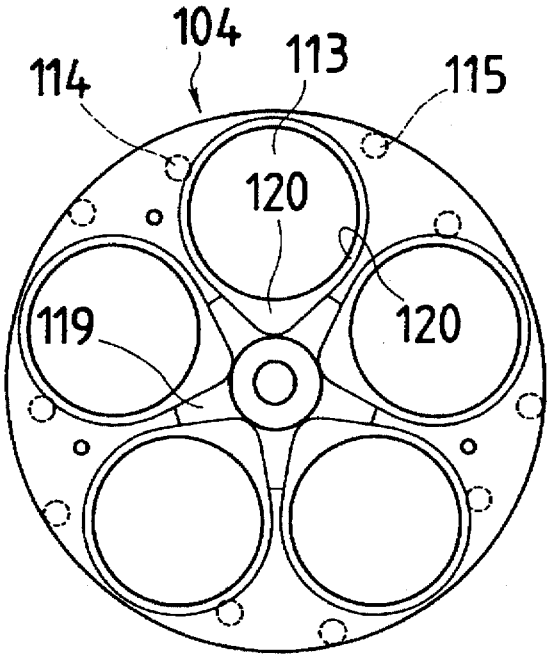
FIGS. 2a, 2b and 2c are a plan view, rear view, and side sectional view, respectively, showing the shape of a disk of the coin dispensing apparatus shown in FIG. 1.
Figure 2B:
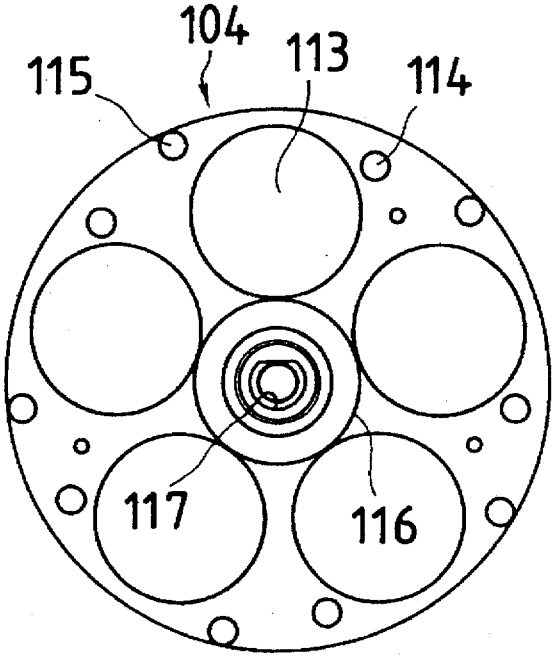
Figure 2C:
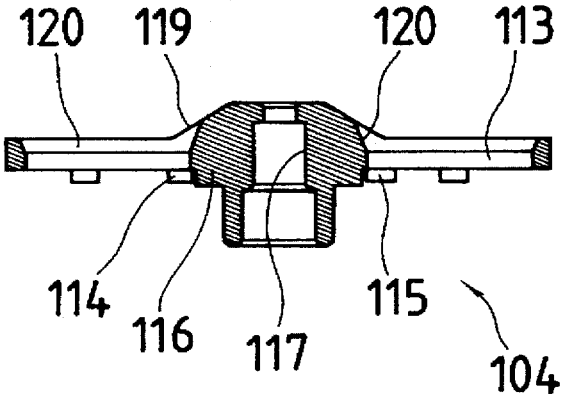

FIGS. 2*a*, 2*b* and 2*c* are a plan view, rear view, and side sectional view, respectively, showing details of the configuration of the disk 104.

The disk 104 has five through holes 113 arranged at regular intervals on the circumference of one circle. Each hole 113 has an inside diameter a little greater than the outside diameter of each coin as an object of dispensation. As shown in FIG. 2*b*, first and second protrusions 114 and 115 are formed on the region near the outer periphery of the back of the disk 104 so that each through hole 113 is situated between them. More specifically, the first protrusion 114 is situated within the radius of an imaginary circle which is inscribed in each through hole 113, while the second protrusion 115 is situated substantially in contact with the outer periphery of the disk 104. The distance between the first and second protrusions 114 and 115 associated with each through hole 113 is a little longer than the diameter of each coin.

As shown in FIGS. 2*b* and 2*c*, a column 116 circumscribed with the through holes 113 is formed integrally with the disk 104. Formed in the center of the column 116 is a drive shaft hole 117 which is partially flattened for engagement. As shown in FIG. 1, a rotating output shaft 118 of the disk drive unit 105, which projects from the base 103, is inserted and fixed in the hole 117. Thus, the disk 104 rotates with the output shaft 118. The column 116 need not always be provided on the disk, and may alternatively be formed separately of the disk 104 so that it can be fitted on the output shaft 118 or formed on the base 103 so that its peripheral wall protrudes along the inner periphery of a through hole 124 of the base 103.

As shown in FIG. 2*a* and 2*c*, the disk 104 is provided with a convex in the form of a truncated cone on its surface. This convex has a slope which declines gradually from the center of rotation of the disk 104 toward the outer periphery. The convex is chamfered integrally with the inner peripheral edge of an obverse-side opening of each through hole 113, and forms a star-shaped stirring rib 119 for stirring the unarranged coins in the hopper 102 (chamfered portions are designated by numeral 120 in FIGS. 2*a* and 2*c*). As shown in FIG. 1 a stirring rod 121 having an elliptic cross section is set up on the obverse side of the disk 104, penetrating the central portion of the disk. The proximal portion of the rod 121 is fixedly fitted in the rotating output shaft 118 of the disk drive unit 105. When the drive unit 105 is actuated, the stirring rod 121 rotates with the disk 104 to thereby break a bridge phenomenon of coins which may be occurred around the bottom opening portion of the hopper 102.

Figure 3A:
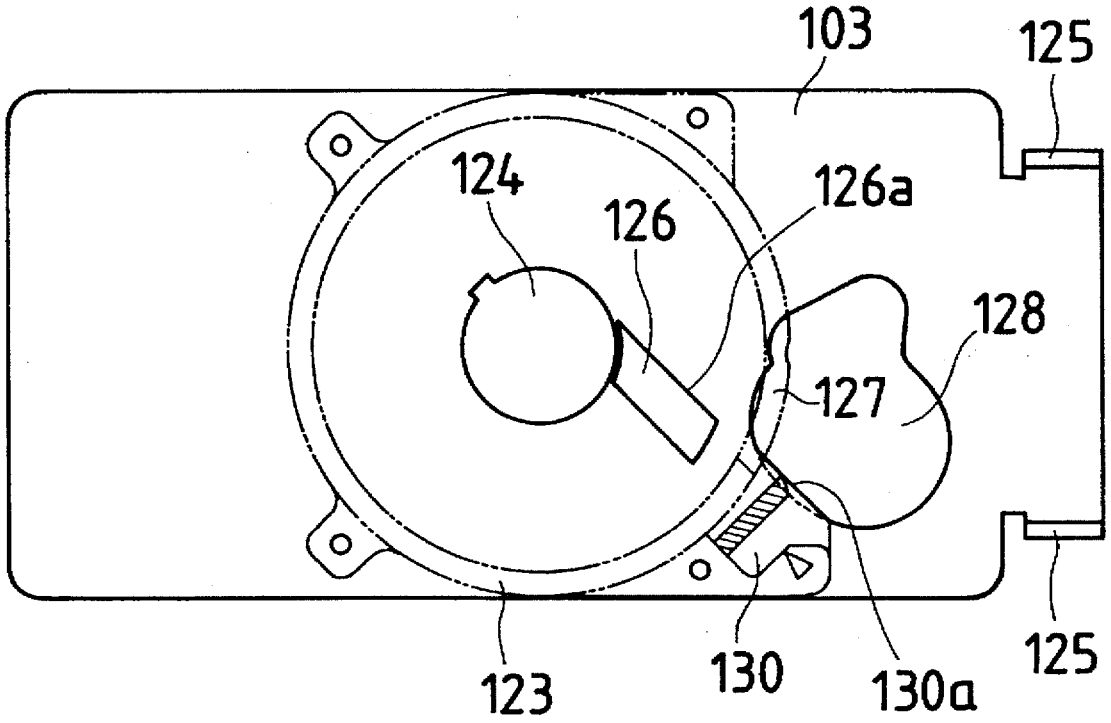
FIGS. 3a and 3b are a plan view and a front view, respectively, showing the shape of a base of the coin dispensing apparatus shown in FIG. 1.
Figure 3B:
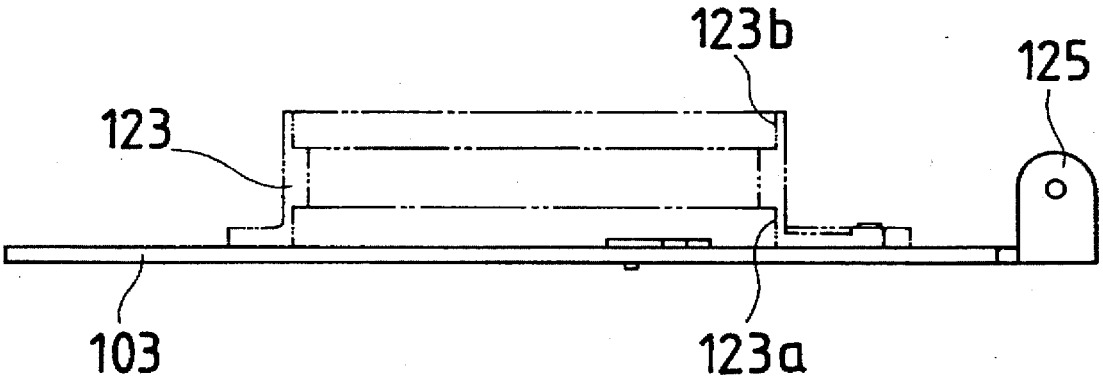

The shape of the base 103 is shown in detail in FIGS. 3*a* and 3*b*.

The through hole 124 having a diameter substantially equal to that of the column 116 of the disk 104 is bored through the central portion of the base 103, and the column 116 is fitted to the hole 124. The ring-shaped connecting member 123 is fitted to the upper surface of the base 103 concentrically with the through hole 124 by screws or the like. As shown in FIG. 3*b*, the inner peripheral edges at both end portions of the connecting member 123 are slightly enlarged in diameter. As shown in FIG. 1, the disk 104 is rotatably fitted in a lower enlarged portion 123*a* and the bottom opening portion of the hopper 102, which is swingably supported by a pivot portion 125 on one side of the base 103, is fitted in an upper enlarged portion 123*b*.

The base 103 is provided with a guide member 126 which extends along the direction of rotation of the disk 104 from the first protrusion 114 toward the second protrusion 115, i.e. along the clockwise direction in FIG. 3*a* in which the disk 104 rotates around the through hole 124. An abutment surface 126*a* of the guide member 126 which contacts with the coins extends along a tangent to a circle defining the through hole 124.

An aperture corresponding to the external shape of the guide member 126 is bored through the base 103, and the guide member 126 projects above the base 103 through this aperture. The guide member 126 is disposed swingable around a pivot (not shown) provided on the underside of the base 103, and is pressed upward from under the base 103 by means of a spring (not shown). In case of overload, therefore, the guide member 126 can recede from the surface of the base 103, resisting the elastic force of the spring. The length of the guide member 126 is a little shorter than the distance from the outer peripheral surface of the column 116 of the disk 104 to the first protrusion 114. Thus, the first and second protrusions 114 and 115 protruding from the lower surface of the rotating disk 104 are prevented from interfering with the guide member 126.

In the peripheral wall of the lower enlarged portion 123*a* of the connecting member 123, there is formed a opening 127 longer than the diameter of a coin as an object of dispensation. The opening 127 extends in the counterclockwise direction, i.e. in the direction opposite to the rotating direction of the disk 104, from a vicinity of the position where the wall meets the extension of the abutment surface 126*a* of the guide member 126. In the base 103, there is bored a coin dispensing port 128 which extends along the opening 127 from the position of the extension of the abutment surface 126*a* of the member 126. Moreover, a guide piece 130 is fixed on the base 103 so as to extend along the extension of the abutment surface 126*a* of the guide member 126. The guide piece 130 has a declining tapered edge portion 130*a* to guide each coin rolling along the guide member 126, so that the coin is dropped into the coin dispensing port 128. The coin dispensed through the dispensing port 128 rolls in a discharge chute 129 which is fixed to the lower surface of the base 103, and is guided to a coin outlet port in the housing of the money changing machine or automatic vending machine.

Referring now to the operational diagrams of FIGS. 4–7, coin dispensing operation of the coin dispensing apparatus 100 according to the present embodiment will be described.

Figure 4:
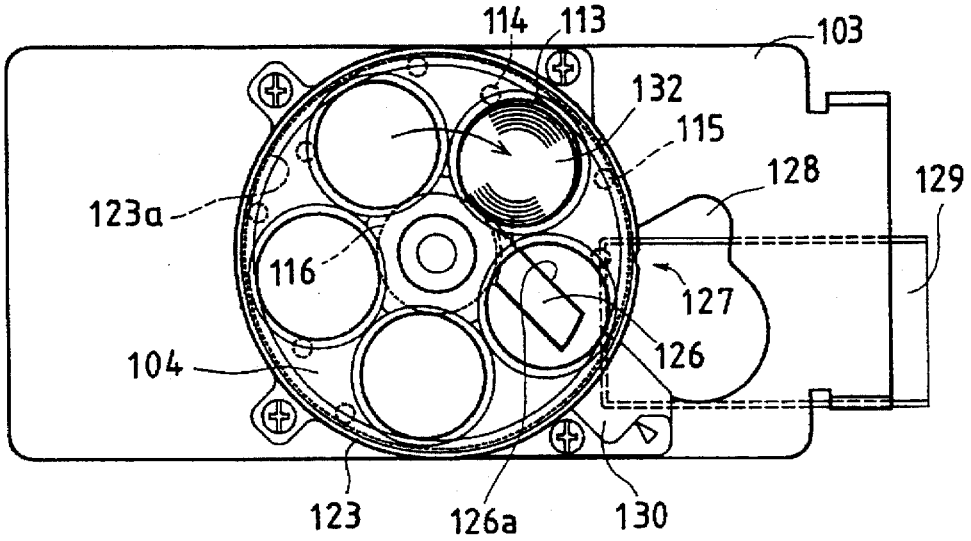
FIGS. 4 to 7 are diagrams for illustrating the coin dispensing operation of the coin dispensing apparatus.

First, when the drive of the disk drive unit 105 is started in response to a coin dispensation command from a control unit of the money changing machine or automatic vending machine, the disk 104 rotates in the clockwise direction in FIG. 4. Thereupon, the coins stored in the lower part of the hopper 102 come into sliding contact with the disk 104, and the stirring rod 121 and the stirring rib 119 stir these coins, thereby diversely changing the posture and position of each coin. Sooner or later, the coin is situated in the rotational position of one of the through holes 113 of the disk 104, and is caught by the hole 113.

Figure 5:
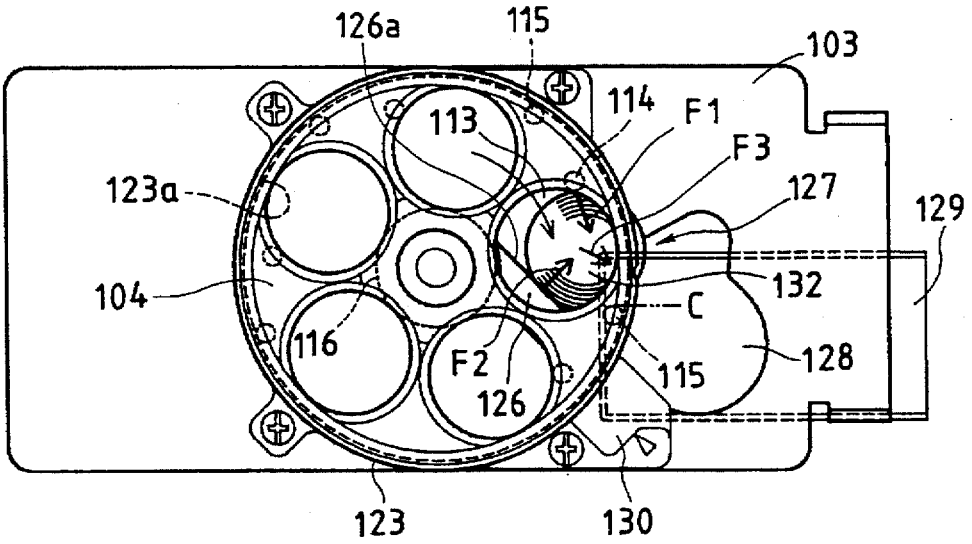
Figure 6:
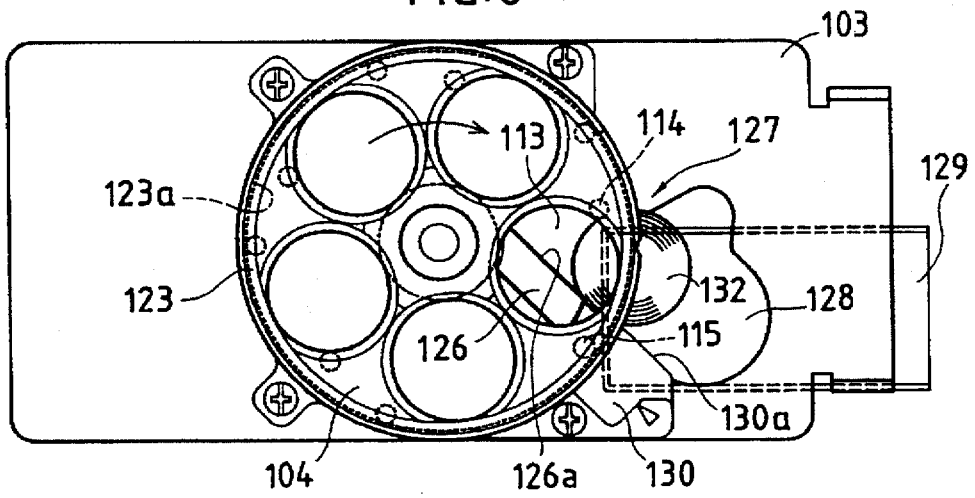

After falling onto the base 103 through the through hole 113, a coin 132 is transported under pressure in the clockwise direction on the base 103 by the first protrusion 114 in a manner such that its path is regulated by the inner wall of the lower enlarged portion 123*a* of the connecting member 123, the column 116 and the second protrusion 115 on the lower surface of the disk 104, as shown in FIG. 4. When an peripheral portion of the coin 132 transported under pressure by the first protrusion 114 abuts against the abutment surface 126*a* of the guide member 126, as shown in FIG. 5, the path of the coin 132 is regulated by the surface 126*a*. Thus, under a vertical drag from the surface 126*a* and the first protrusion 114, the coin 132 is pushed toward the opening 127 in the lower enlarged portion 123*a* of the connecting member 123. The coin 132 passes through the gap between the first and second protrusions 114 and 115 associated with the through hole 113 and through the opening 127. The coin 132 is then gradually forced out along the abutment surface 126*a* and the lateral surface of the guide piece 130 toward the outer periphery of the disk 104, as shown in FIGS. 5 and 6. Thus, the coin 132 dropped onto the base 103 through the through hole 113 is smoothly delivered to the outer periphery of the disk 104 without abruptly changing its moving direction. Accordingly, the coin 132 does not apply an impulsive force to the first protrusion 114 and the guide member 126.

FIG. 5 shows a state immediately after the coin 132 is held between the first protrusion 114 and the guide member 126 under pressure. At this time, a force to deliver the coin 132 to the outer peripheral side of the disk 104 is produced by vertical drags F1 and F2 which the coin 132 receives from the first protrusion 114 and from the engaging surface 126*a*, respectively. A resultant force F3 of these drags acts in the direction substantially parallel to the guide member 126 and directed to push out the coin 132 from the center of the coin 132 to the outer periphery of the disk 104. More specifically, the vertical drag F2 which the coin 132 receives from the engaging surface 126*a* is a counteraction to a stress acting on the guide member 126 as a normal component of the vertical drag F1 which the coin receives from the first protrusion 114, at the point of contact between the coin 132 and the abutment surface 126*a*. Thus, the resultant force F3 of F1 and F2 has the same direction and magnitude as a tangent component of the force at the contact point of the coin 132 and the guide member 126. According to the present invention, the abutment surface 126*a* of the guide member 126 extends along the direction tangent to the circle defining the outer periphery of the column 116, so that the coin 132 can be forced out smoothly although the first protrusion 114 is located near the outer periphery of the disk 104.

In the conventional coin dispensing apparatuses, a member corresponding to the guide member 126 is located in a position near the outer periphery of the disk 104 so as to extend along the radial direction of the column 116, as indicated by two-dot chain line C in FIG. 5, for example. At the moment when the coin abuts against the abutment surface 126*a*, therefore, the coin suddenly changes its course and applies impulsive forces to the guide member and the protrusions. If the protrusion for pressing the coin 132 is located closer to the outer periphery of the disk 104, the coin 132 is entirely held between the protrusion and the guide member, i.e. the resultant force of the vertical drags produced by the protrusion and the guide member is directed inward from the outer peripheral side of the disk 104. Accordingly, the resultant force cannot push out the coin 132 from the inside the disk 104 to the outside. If the protrusion for pressing the coin 132 is located nearer to the column 116, on the other hand, the force to push out the coin is directed to the outside of the disk 104. However, this force is not great enough to push out the coin 132 smoothly, so that the coin 132 must be moved toward the guide member by using any other means, such as a guide pin. In some cases, the coin may have to be scraped out by a scraper.

Figure 7:
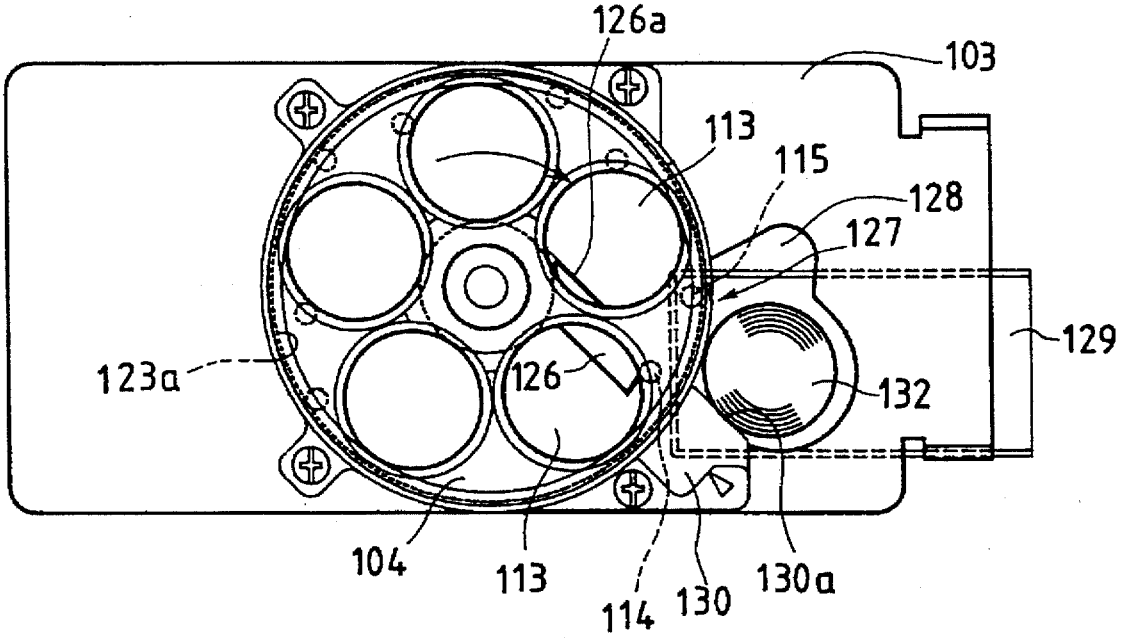

When the disk 104 is further rotated in the clockwise direction from the state shown in FIG. 5, the coin 132 is discharged to the position outside the disk 104, except almost ¼ of its body corresponding to the distance from the location of the first protrusion 114 to the outer periphery of the disk 104. At this time, the coin 132 is guided by the tapered edge portion 130*a* on one side of the guide piece 130, and is allowed to fall through the coin dispensing port 128 by gravity. When the coin 132 is not entirely discharged to the outside of the disk 104 by the push of the first protrusion 114, its remaining end portion is pressed by the second protrusion 115 associated with the next through hole 113 disposed adjacent the through hole 113 carrying the coin 132, in the direction opposite to the rotating direction of the disk 104. Thus, the coin 132 is entirely discharged to the outside of the disk 104, as shown in FIG. 7, where it is guided by the tapered edge portion 130*a* on the one side of the guide piece 130, and falls through the coin dispensing port 128 by gravity. After falling through the dispensing port 128, the coin 132 rolls on the discharge chute 129 which is fixed to the lower surface of the base 103, and is guided to the coin outlet port in the housing of the money changing machine or automatic vending machine.

Thereafter, the coins are caught individually by the through holes 113, and transported under pressure in the clockwise direction by the first protrusions 114 associated with the holes 113, in a manner such that their respective paths are regulated by the inner peripheral wall of the lower enlarged portion 123*a* of the connecting member 123, the column 116, and the second protrusions 115 associated with the holes 113. Then, the coins are successively held by the protrusions 114 and the guide member, passes through the opening 127 of the lower enlarged portion 123*a* of the connecting member 123 in the same manner as described, and discharged into the coin outlet port in the housing of the money changing machine or automatic vending machine through the coin dispensing port 128 and the discharge chute 129.

In the first embodiment described above, the first and second protrusions 114 and 115 are arranged separately on the reverse of the disk 104. The same effect can, however, be produced by integrally forming each combination of the first and second protrusions which are located between the two adjacent through holes 113 and respectively associated with the adjacent holes 113. If the first and second protrusions 114 and 115 are integrally formed in this manner, the coin once pushed out to the outside of the disk 104 by the first protrusion 114 is prevented from being jammed between the protrusion 114 and the second protrusion 115 which is associated with the next through hole 113 and from hindering the dispensing operation. This arrangement is suitably used for the case in which the base 103 is set in a tilted position.

Figure 8:
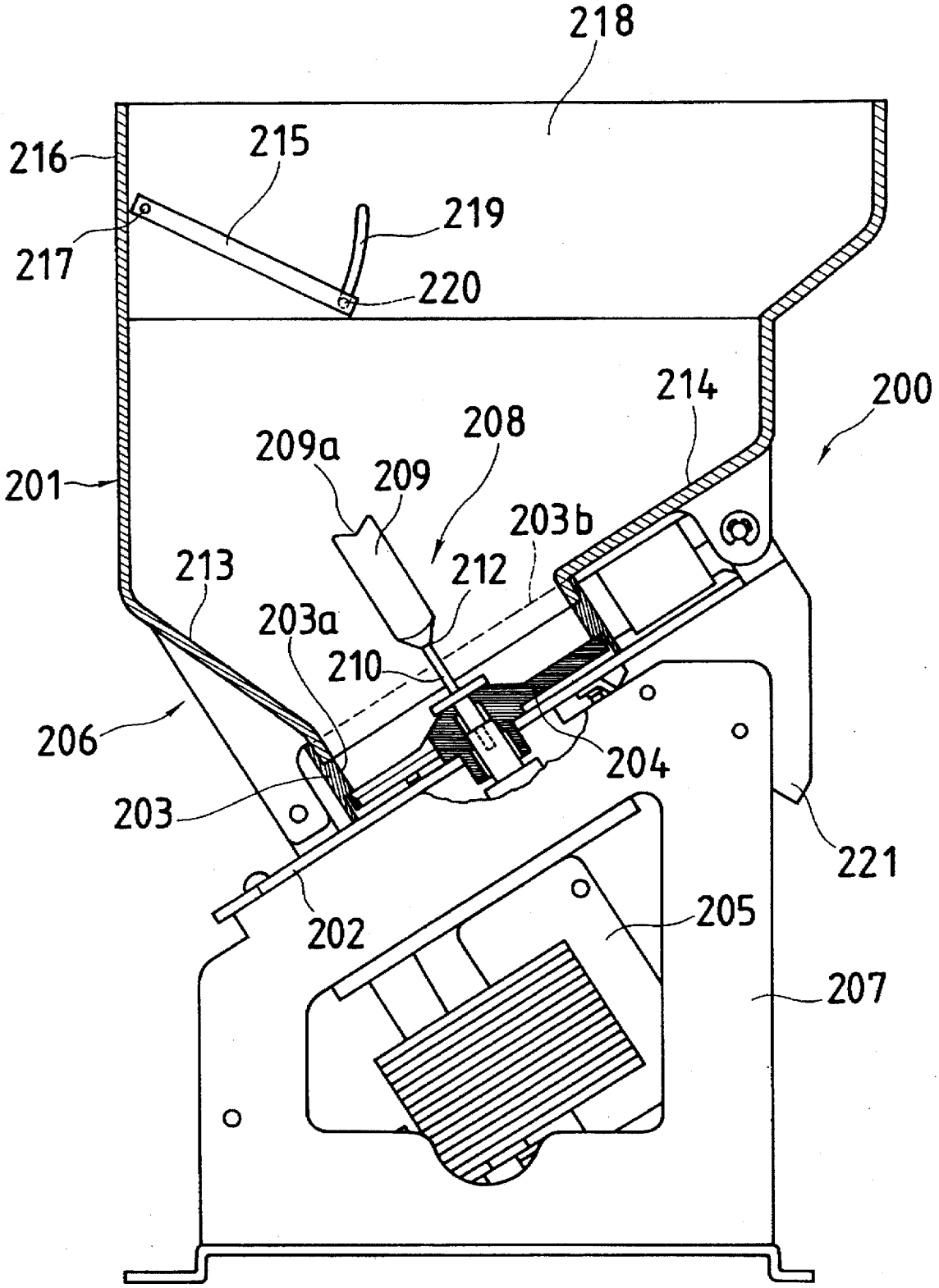
FIG. 8 is a side view showing an arrangement of a coin dispensing apparatus according to another embodiment of the present invention.

Hereinafter, a second embodiment of the present invention will be described referring to FIGS. 8 and 9. As shown in FIG. 8, a coin dispensing apparatus 200 comprises a translucent hopper 201 for storing coins, a base 202 for swingably supporting the hopper 201, a connecting member 203 disposed between a bottom opening portion of the hopper 201 and the base 202 and having a hub-shaped peripheral wall 203*a*, a disk 204 rotatably disposed in the connecting member 203, a disk drive unit 205 mounted on the lower surface of the base 202 for rotating the disk 204 by means of a geared motor or the like, and two side plates 207 for mounting a dispensing apparatus body 206 including these members in a housing of a money changing machine or automatic vending machine.

Figure 9A:
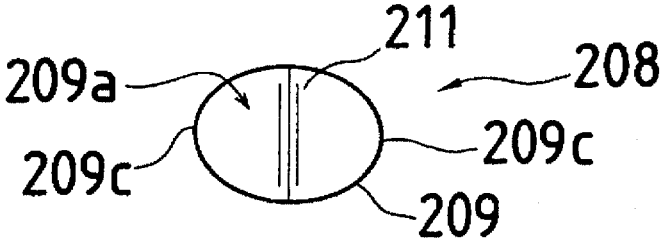
FIGS. 9a, 9b and 9c are a top view, a front view, and a side view, respectively, showing the shape of a coin stirring rod of the coin dispensing apparatus shown in FIG. 8.
Figure 9B:
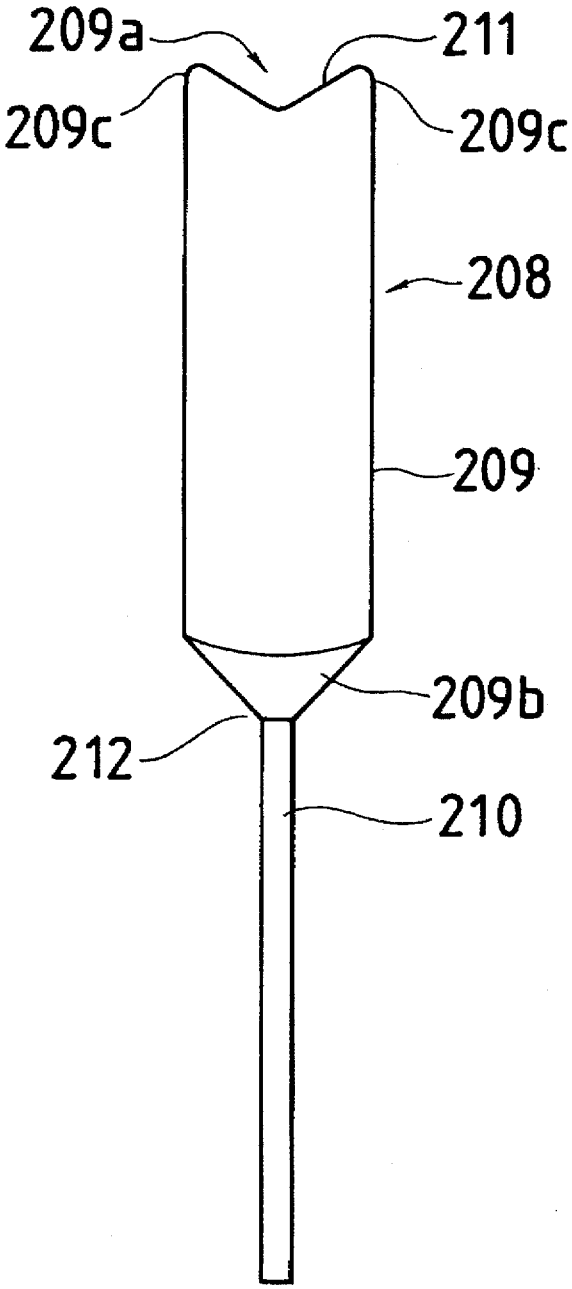
Figure 9C:
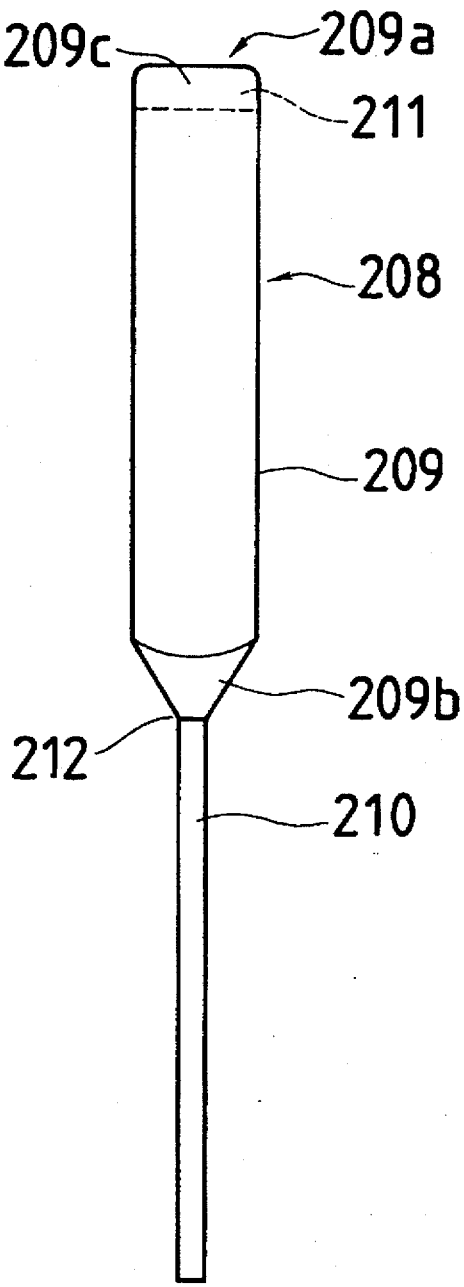

A coin stirring rod 208 is fixedly mounted on the upper surface of the disk 204 so as to extend along its center of rotation. As shown in the top view of FIG. 9*a*, front view of FIG. 9*b* and side view of FIG. 9*c*, the stirring rod 208 is composed of a rigid portion 209 having an elliptic solid section in the diametrical direction, and a rod 210 having a circular solid section perpendicular to the axis thereof. The rigid portion 209 is fixed to or formed integrally with the rod 210. The diametrical section of the rigid portion 209 is not limited to the elliptic shape, and may be in any other non-circular shape such that the outer periphery of the rigid portion 209 serves as relative protuberances which can stir the coins as the rigid portion 209 rotates in the present embodiment, the rigid portion 209 of the coin stirring rod 208 is formed of a high-rigidity plastic material, and the rod 210 made of a steel material, which has a bent, rolled or pinned tip end for preventing the rotation or disengagement, is inserted integrally into the rigid portion 209. As shown in FIG. 9*a*, a V-shaped groove 211 is formed in an upper end surface 209*a* of the rigid portion 209 so as to extend along the minor axis of the ellipse in the diametrical section of the rigid portion 209. As shown in FIGS. 9*b* and 9*c*, a lower end 209*b* of the rigid portion 209 is in the form of a cone which is gradually tapered toward a junction 212 to the rod 210. The junction 212 here means an apparent junction between the rigid portion 209 and the rod 210, and does not indicate the joint surface between the rigid portion 209 and the rod 210 when the rod 210 is inserted and fixed in the rigid portion 209.

The length of the rod 210 is settled in a manner such that the upper end of the exposed portion of the rod 210 is higher than the upper end of the connecting member 203 of the hopper 201 when the coin stirring rod 208 is fixed to the upper surface of the disk 204 along the center of rotation thereof, as shown in FIG. 8. The length of the exposed portion of the rod 210 varies depending on the thickness of the disk 204 and design requirements for mounting the rod 210 on the disk 204. To be exact, the vertical distance from the upper surface of the base 202 to the junction 212 have to be longer than the vertical distance from the upper surface of the base 202 to an upper edge 203*b* of the connecting member 203. The coin stirring rod 208 is fixed at right angles to the surface of the disk 204 along the center of rotation thereof. However, since the disk 204 itself is tilted when it is mounted, the stirring rod 208 is inclined at a predetermined angle (e.g., 60!k) narrower than 90!k to a horizontal plane.

The hopper 201 is in the form of a rectangular box having an external shape substantially coincident with an outline of the base 202 projected on a horizontal plane. At the bottom portion of the hopper 201, walls 213 and 214 are provided for defining slopes for guiding the coins stored in the hopper 201 toward the disk 204 in the connecting member 203.

In the hopper 201, a load dispersing plate 215 is provided on the side which the operator faces when loading the coins into the hopper 201 to fill it. One end portion of the plate 215 is pivotally supported by a rotative shaft 217 which extends horizontally along a wall 216 on the side that the operator faces. An arcuate groove 219 is formed in the inner surface of each of opposite walls 218 which adjoin the wall 216. A dowel 220 which projects from each side of the other end portion of the load dispersing plate 215 is fitted to the groove 219. Thus, the plate 215 is swingable within a predetermined range and extends in the hopper 201 so as to overhang the coin stirring rod 208.

The range of the swinging motion of the load dispersing plate 215 is restricted by the engagement of the groove 219 and the dowel 220. However, only the lower limit of the swinging motion of the plate 215 is necessary to be restricted, and the upper limit need not always be restricted. Thus, the same object can be achieved by forming a protrusion on the inner surface of each side wall 218 at the position corresponding to the position of the lower end of the groove 219, and using the protrusion to support each side portion of the free end of the load dispersing plate 215 having no dowel thereon. If the protrusion is formed on the inner surface of each wall 218, some of the coins may possibly be jammed between the protrusion and the plate 215, thereby preventing the plate 215 from descending to its desired swinging motion limit. Moreover, an arcuate through hole may be formed in place of the arcuate groove 219 in each side wall 218. Depending on the size of the through hole, however, there is a fear of some of the coins falling. If any of the coins are caught in the hole, the load dispersing plate 215 may possibly be restrained from swinging upward. The above-described groove 219 and the dowel 220 are designed taking the circumstances into consideration. If the aforesaid drawbacks are insignificant, the plate 215 may be supported by the protrusions formed on the respective inner surfaces of the walls 218, or the arcuate through holes may be used in place of the arcuate grooves 219.

These swinging motion restricting means need not always be provided on the end portion opposite to the pivoted end of the load dispersing plate 215. If the mechanical strength of the material of the plate 215 permits, the aforesaid various restricting means or alternative ones may be provided in positions near the rotative shaft 217. For example, the swinging motion limits of the load dispersing plate 215 can be restricted by an arrangement such that the rotative shaft 217 is fixed to one of the plate 215 or the wall 218 and a fitting hole for pivotally supporting the shaft 217 is formed in the other, a fitting portion of the shaft 217 and the fitting hole having deliberately designed shapes. The following is a proposal of a way of restricting the swinging motion limits, as an example. A swinging motion restricting portion, which has a solid sector in the diametrical section with its center pivoted on the axis of the rotative shaft 217, is provided covering about half the axial length of the fitting portion of the shaft 217 which has a solid circular diametrical section. On the other hand, a swinging motion restricting piece having a solid sector in the diametrical section is provided covering about half the axial length of the fitting hole. Also, the respective remaining halves of the rotative shaft 217 and the fitting hole are both formed to have a circular shape such that the rotation of the shaft 217 is allowed. Thus, the swinging motion is restricted by the interference between the respective solid sectors of the restricting portion of the rotative shaft 217 and the restricting piece of the fitting hole. In this case, when the apex angles of the sectors of the restricting portion and the restricting piece are A!k and B!k, respectively, the swinging angle of the load dispersing plate 215 is (360-A-B)!k as a whole.

In the state shown in FIG. 8, the load dispersing plate 215 is lowered to its lower swinging motion limit by gravity. In this state, the angle formed between the plate 215 and a horizontal plane is a little wider than the angle at which the coins on the plate 215 slide down the plate 215 by gravity, resisting a static frictional force between the coins and the plate 215. Thus, the coins can easily slide down from the load dispersing plate 215.

The coin dispensing apparatus 200 according to the present embodiment is not different from the one according to the first embodiment with respect to the arrangement of other components including the base 202, disk 204, disk drive unit 205, side plates 207, etc., capture of the coins by holes provided in the disk 204, processes of coin transportation to a coin dispensing port 221. Since these particulars have no influences upon the operations and effects of the present embodiment which are given by the coin stirring rod 208 and the load dispersing plate 215, a description of those elements which have the same constructions and functions as their counterparts in the aforesaid embodiment is omitted.

The following is a description of the operations and effects of the coin dispensing apparatus 200 according to the second embodiment.

First, in a preparation for users' operations of the money changing machine or automatic vending machine which is furnished with the coin dispensing apparatus 200, the operator who manages the apparatus 200 is required to replenish the hopper 201 with a predetermined number of coins. As mentioned before, the coin loading operation for the replenishment is performed on the side of the front wall 216 of the hopper 201. In doing this, the coins thrown by the operator run at a dash into the hopper 201, so that a substantial impact is caused inevitably. Since the coins loaded into the hopper 201 are damped by running on the load dispersing plate 215 and then gradually fill the hopper from the bottom thereof, they never give a direct shock to the coin stirring rod 208. Thus, bending or other damage to the rod 208 is prevented.

The coins gradually filling the hopper 201 from the bottom soon reach the level of the location of the load dispersing plate 215. As the coins are loaded additionally, they are piled on the plate 215. The load of the coins on the plate 215 is, transmitted to the side walls 218 of the hopper 201 through the rotative shaft 217 and the dowel 220, and is supported by the hopper 201 and the base 202. Therefore, if the capacity of the hopper 201 itself is equal to that of conventional one, the load acting on the disk 204 disposed at the bottom of the hopper 201 is smaller than in the conventional cases. Accordingly, when a plenty of coins are stored in the hopper 201, the driving torque of the motor which rotates the disk 204 is reduced considerably, and the coins can not be easily conglomerated by an excessive force of pressure from above. Thus, the load dispersing plate 215 lightens the load on the disk 204, thereby preventing extraordinary rotation of the disk and overloading of the motor, and also preventing the conglomerate phenomenon or bridging of coins caused by overload. In this manner, the plate 215 functions as means for facilitating smooth coin dispensing operation.

When the drive of the disk drive unit 205 is started in response to a coin dispensation command from the control unit of the money changing machine or automatic vending machine after the replenishment with coins is completed, the disk 204 rotates so that the coins are taken out one after another from the bottom side of the hopper 201 by the same operations for catching and transporting the coins as in the first embodiment, and are discharged through the coin dispensing port 221. Even during the dispensing operation immediately after the completion of the replenishment with coins, as mentioned before, the loads acting on the motor and the coins stored in the lower portion of the hopper 201 are smaller than in the conventional cases. Thus, the coins are dispensed smoothly.

Figure 10:
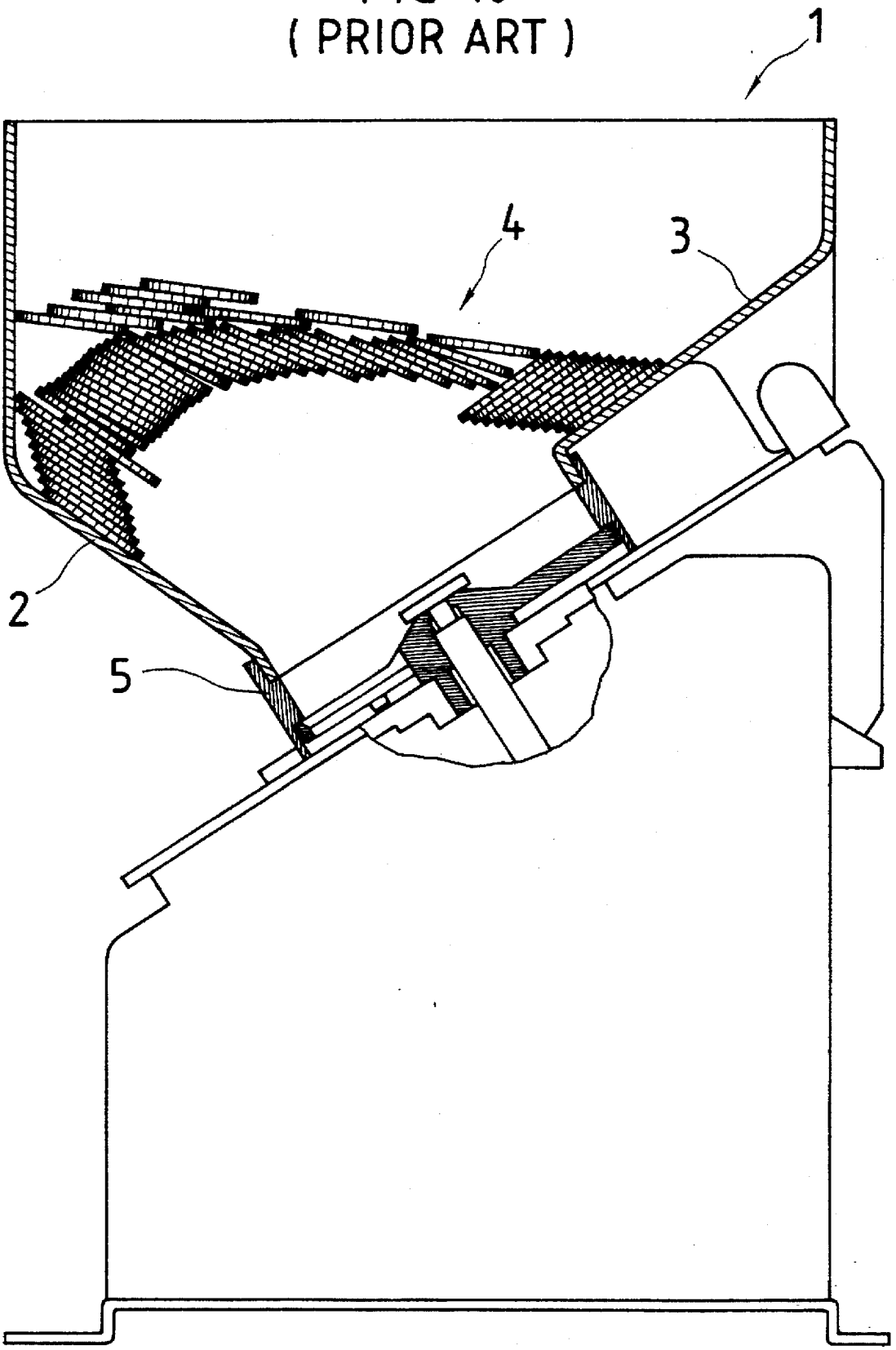
FIG. 10 ( PRIOR ART )
FIGS. 10 and 11 are diagrams showing examples of coin bridges supported on walls of a hopper in a conventional coin dispensing apparatus.
Figure 11:
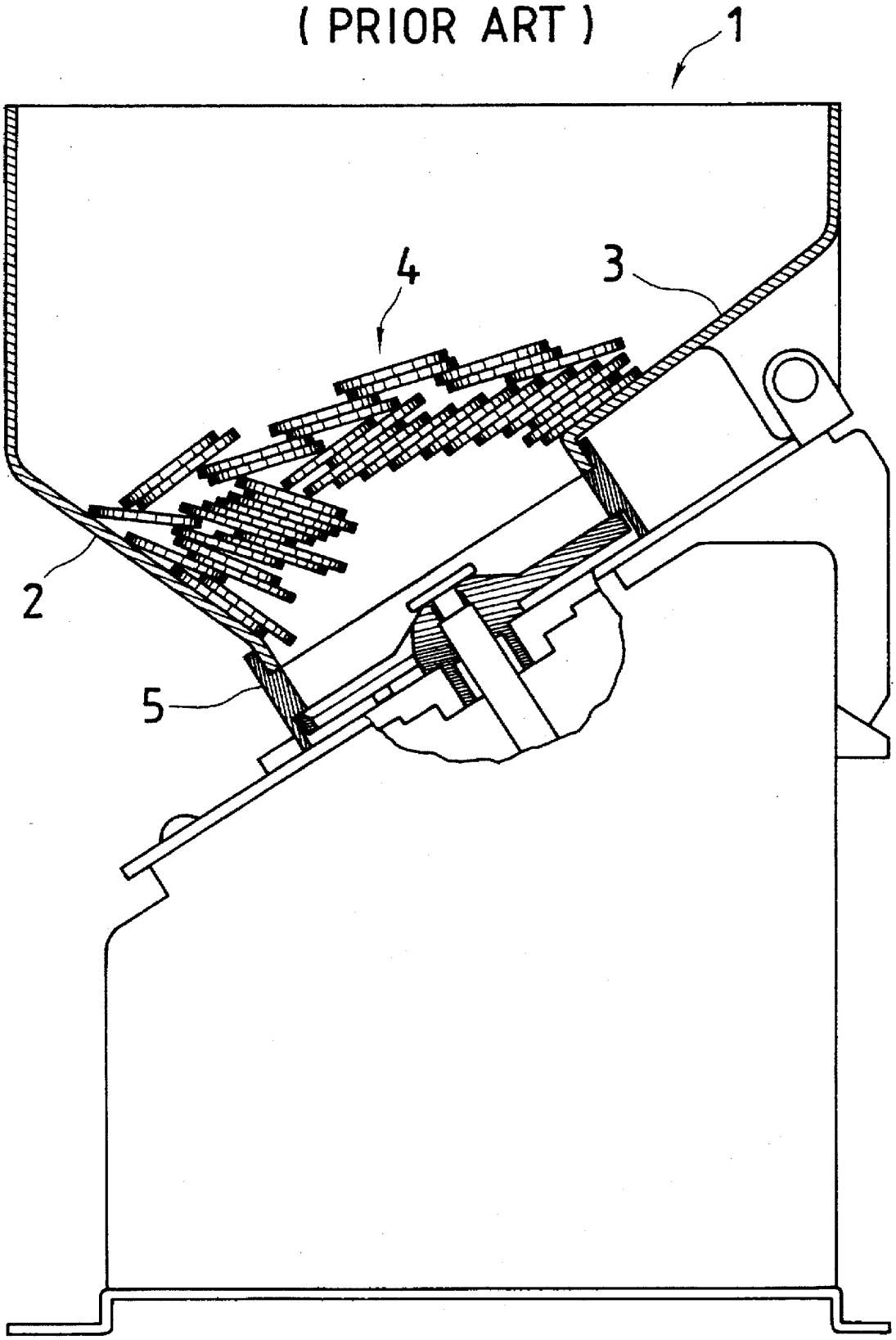
FIG. 11 (PRIOR ART)
Figure 12:
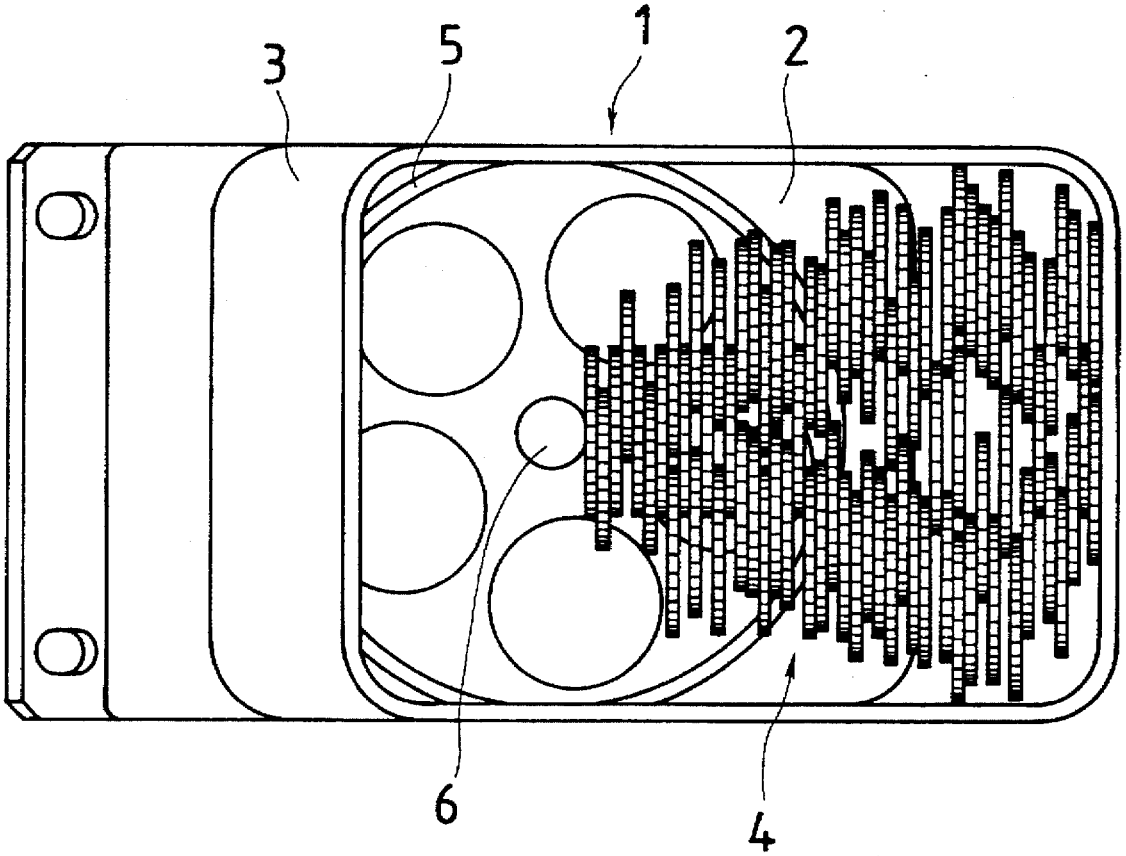
FIG. 12 (PRIOR ART)
FIG. 12 is a diagram showing an example of the bridging caused when coins are arranged parallel to a coin stirring rod in the conventional coin dispensing apparatus.

As the coins in the lower portion are taken out one after another by the dispensing operation, the distribution of the coins and the state of contact between the coins in the hopper 201 change diversely. Every time a coin is dispensed, the relative protuberances of the rigid portion 209 rotating together with the disk 204, i.e., the side end portions projecting along the major axis of the elliptic section of the rigid portion 209, stir the coins surrounding the rigid portion 209. This stirring motion is propagated to a number of coins in the hopper 201 via the adjacent coins. The stirring motion acts in a direction such that the distribution of the coins in the hopper 201 is more natural or uniform. Thus, the stirring motion prevents at least the occurrence of bridges of the types shown in FIGS. 10 and 11, which may be caused in the region below the upper end 209*a* of the rigid portion 209. The stirring effect is produced as the relative protuberances of the rigid portion 209 press the coins surrounding the rigid portion 209. Therefore, if the coins are arranged with their respective faces parallel to the central axis of the rigid portion 209, as shown in FIG. 12, for example, this situation can be gradually removed without being affected by the upright posture of the coins. This cannot be achieved by an arrangement such that the coins are stirred by a spiral ridge for producing a vertical thrust.

However, the stirring effect produced by the motion of the outer peripheral portion of the rigid portion 209 is not always propagated satisfactorily to those coins which stored above the upper end face 209*a* of the rigid portion 209. Thus, there is a possibility of causing bridges of the types shown in FIGS. 16 and 17, for example, which are supported on the walls 213 and 214 of the hopper 201 and the upper end 209*a* of the rigid portion 209. However, the upper end 209*a* of the rigid portion 209 has the V-shaped groove 211 extending along the minor axis of the elliptic section to both ends 209*c* in the direction of the major axis (see FIG. 9*b*). Therefore, as the rigid portion 209, which is inclined at the predetermined angle to a horizontal plane, rotates, opposite end portions 209*c* of the groove 211 move relatively extensively in the vertical direction. As the end portions 209*c* move up and down in this manner, the coins supported on the upper end 209*a* of the rigid portion 209 are shaken vertically and also subjected to horizontal shaking by a scratching effect from the opposite end portions 209*c*.

Figure 16:
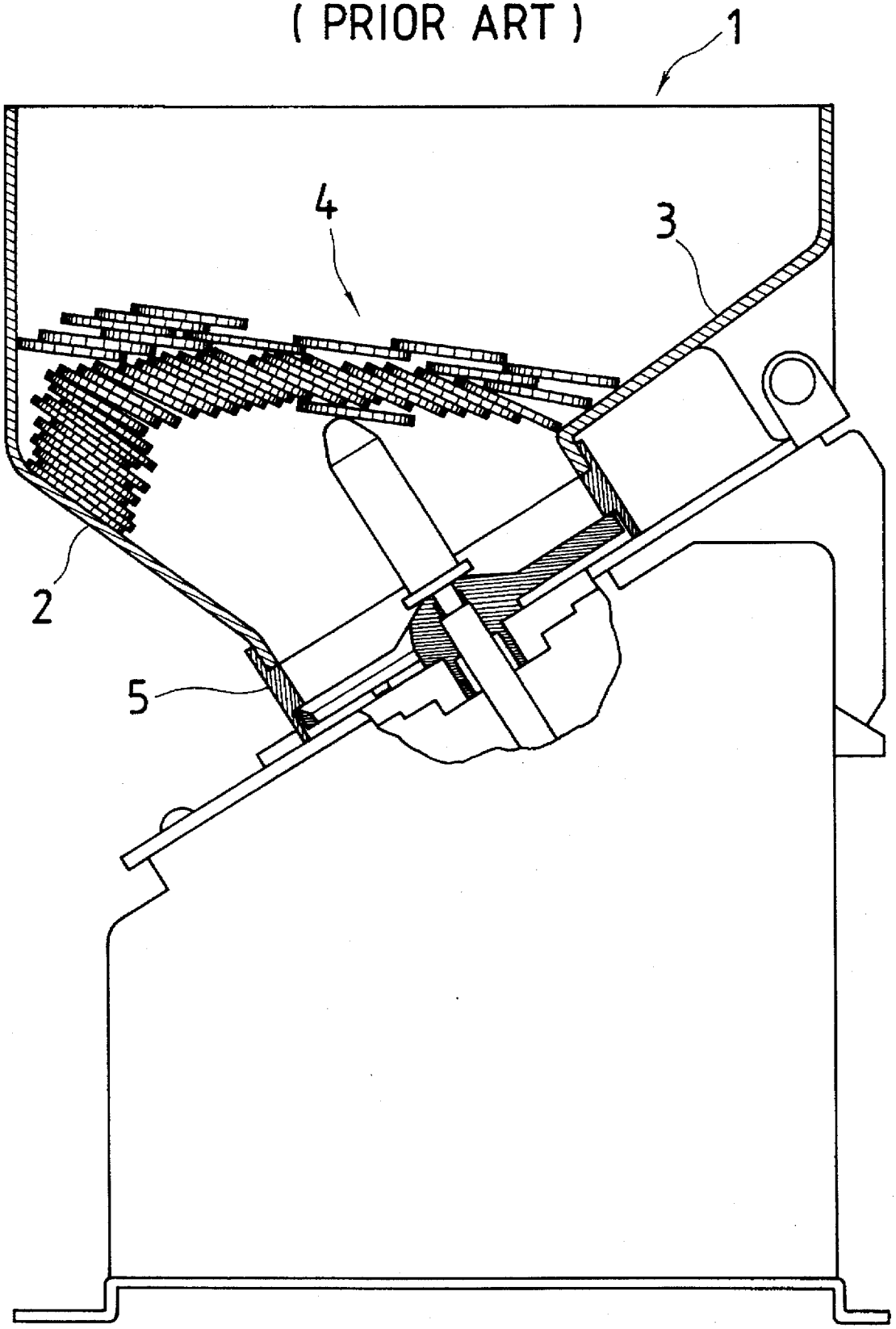
FIG. 16 ( PRIOR ART )
FIGS. 16 and 17 are diagrams showing examples of coin bridges supported on the walls of the hopper and the tip end of a coin stirring rod in the conventional coin dispensing apparatuses.
Figure 17:
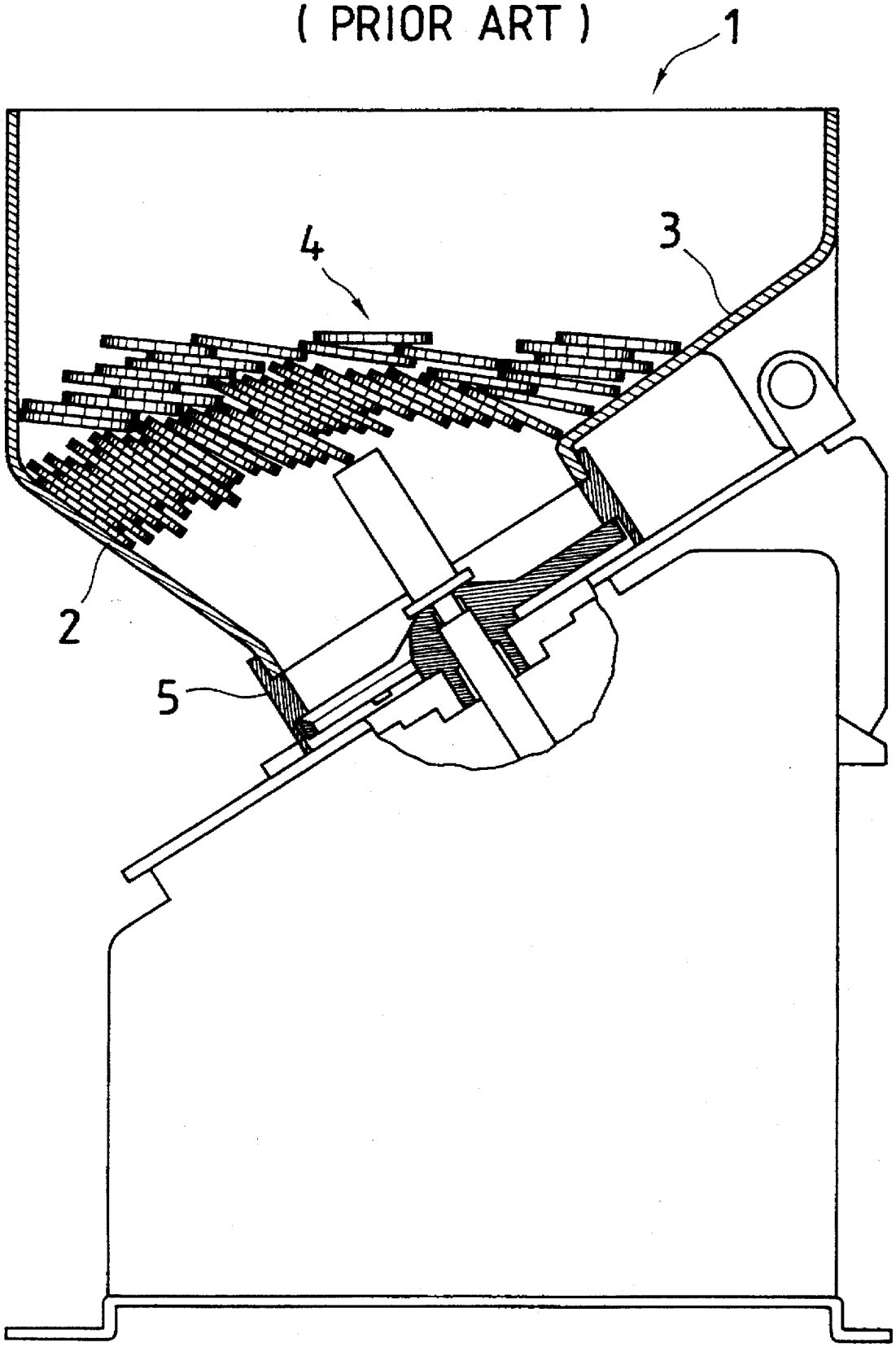
FIG. 17 ( PRIOR ART )

As a result, it becomes difficult for the coins supported on the upper end 209*a* of the rigid portion 209 to maintain the state shown in FIG. 16 or 17, and the coins are sprung out of the position over the upper end face 209*a*, so that the central portion of the bridge is removed. This leads to a collapse of the whole bridge. The up-and-down motion of the opposite end portions 209*c* is relatively extensively only when it is compared with the case where the V-shaped groove 211 is formed along the major axis of the elliptic section on the upper end 209*a*. In order to remove the bridge on the tip end of the rigid portion 209, it is preferable to form the V-shaped groove 211 along the minor axis of the elliptic section on the upper end face 209*a* so that the up-and-down motion and scratching effect of wedge-shaped bumps on the opposite crosswise end portions are enhanced. If the groove is formed along the major axis, however, these effects are not ruined. The same applies to the case where the diametrical section of the rigid portion 209 has another nonrotational shape, such as the shape of a rectangle or gourd. More specifically, it is desirable to form the V-shaped groove in the direction perpendicular to the maximum diameter of the cross section so that the stirring effect produced by the up-and-down motion and scratching action of the wedge-shaped bumps on the opposite ends of the groove are enhanced.

Figure 13:
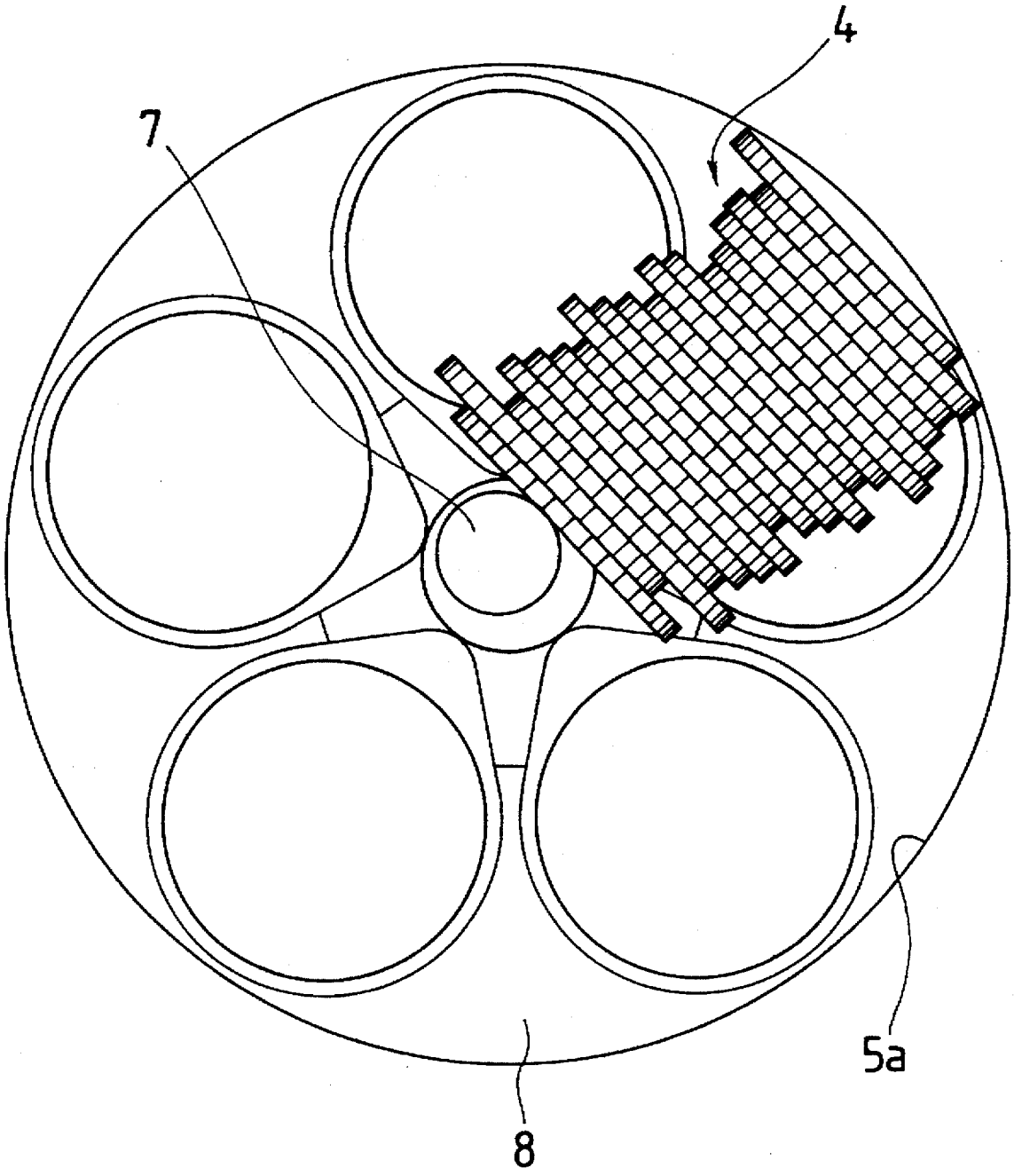
FIG. 13 ( PRIOR ART )
FIGS. 13 and 14 are diagrams showing examples of a locking caused when the coins are arranged parallel to a coin stirring rod in the conventional coin dispensing apparatuses.
Figure 14:
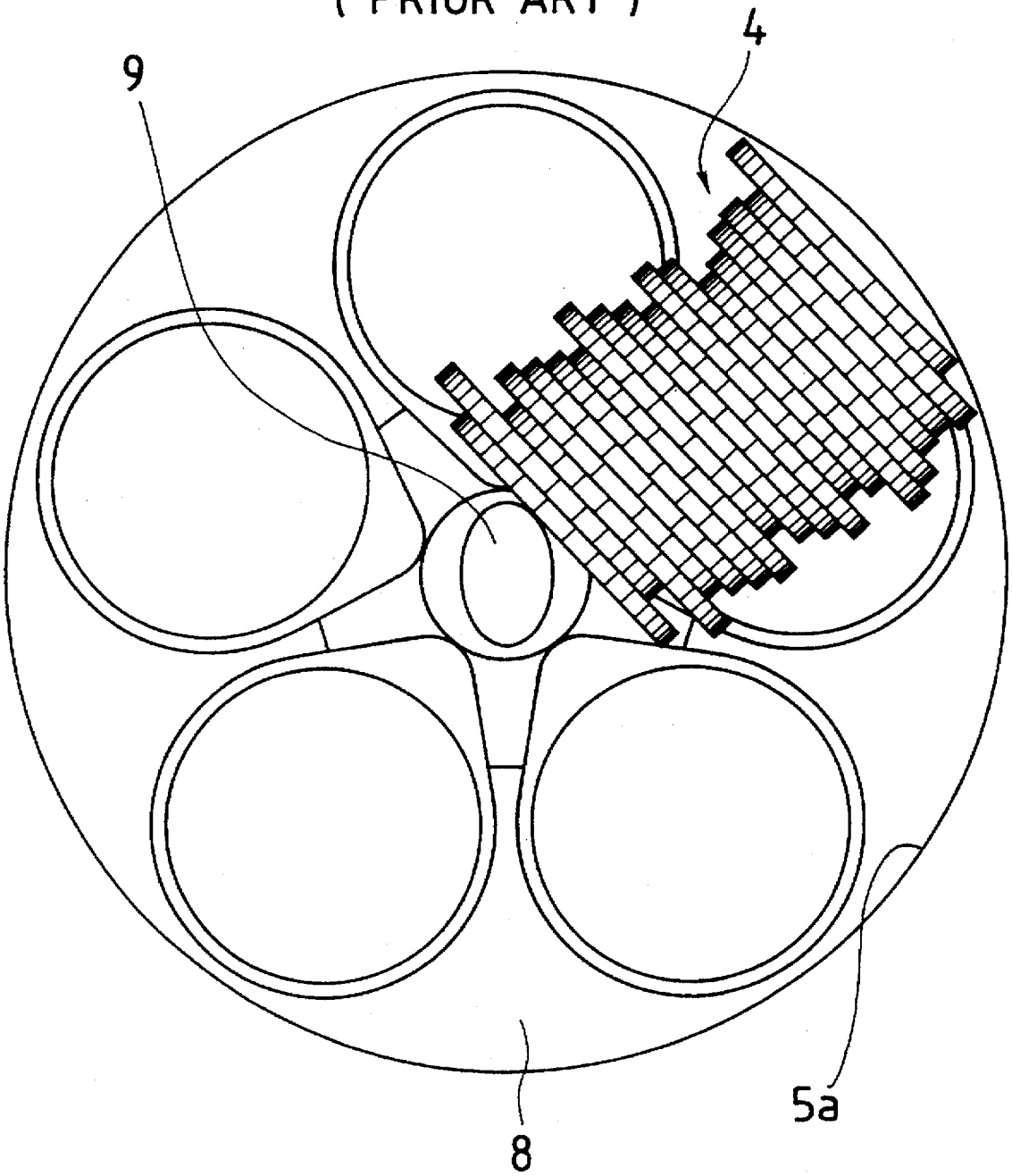
FIG. 14 ( PRIOR ART )

While the movement of the coins caused with the coin dispensing operation and relating to the occurrence and removal of the bridge is repeated in the hopper 201, a number of coins may possibly be tightly arranged between the inner peripheral wall 203*a* of the connecting member 203 and the coin stirring rod 208 in the hopper 201, with their respective faces parallel to the central axis of the rod 208, as shown in FIGS. 13 and 14. However, the rigid portion 209, which has the section in the nonrotational shape, is not located below the upper edge 203*b* of the connecting member 203, and only the rod 210 for supporting the rigid portion 209 is set up there. Since the rod 210 has a circular sectional contour, there is no possibility of the coins being held under high pressure between the rod 210 and the inner peripheral wall 203*a* and preventing the rod 210 from rotating. If such a phenomenon occurs in the region above the connecting member 203, the rod 210 temporarily elastically bends, thereby causing the relative protuberances of the rigid portion 209, i.e. the end portions 209*c* along the major axis which interfere with the arranged coins, to recede from the coins, so that the rigid portion 209 itself is not prevented from rotating. Since the factors which hinder the rotation of the rod 210 and the rigid portion 209 are removed in this manner, the locking of disk 204 and the overload of the motor are prevented.

Figure 15:
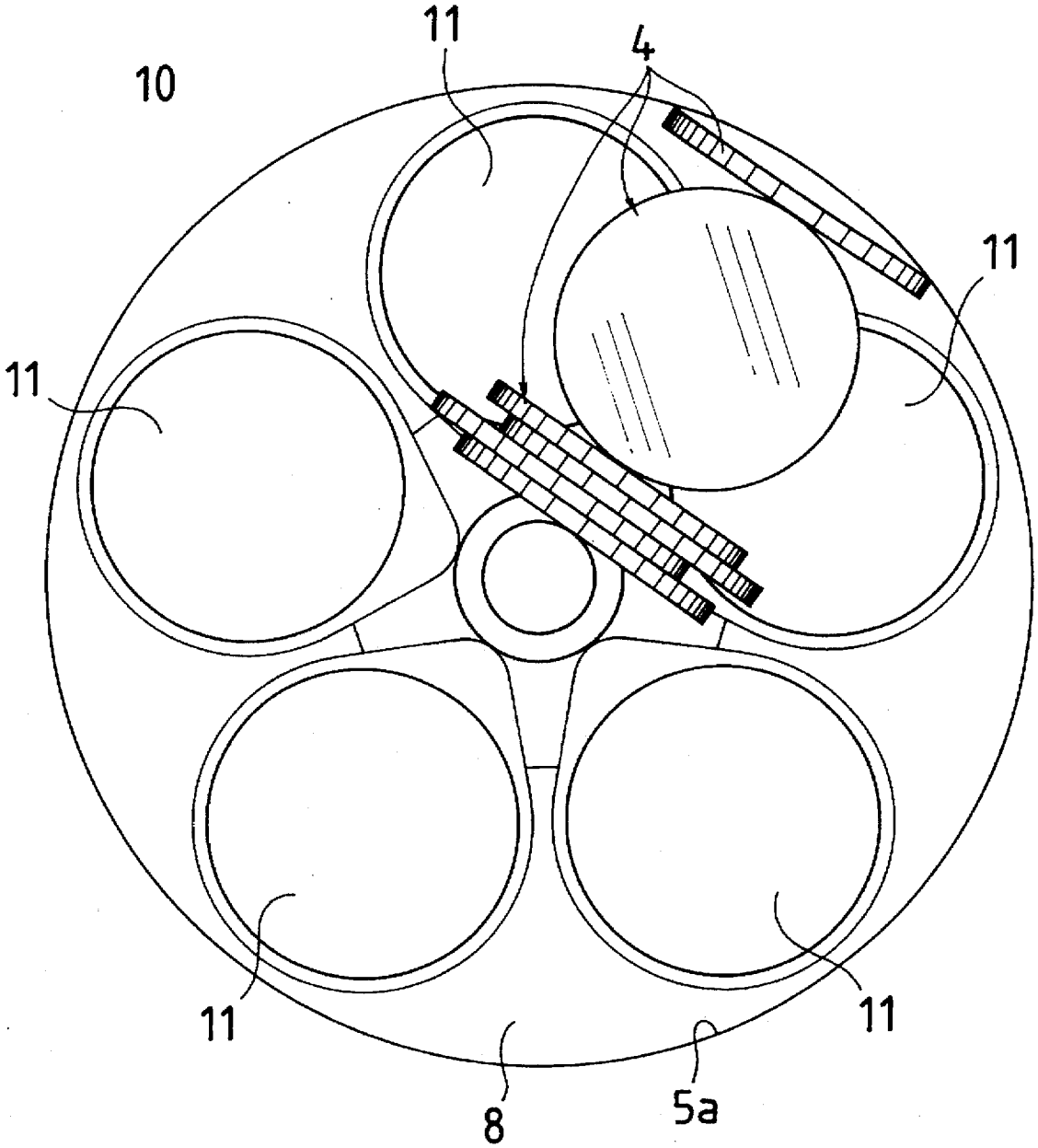
FIG. 15 ( PRIOR ART )
FIG. 15 is a diagram showing a state in which the coins are elastically supported by a coin stirring rod in the conventional coin dispensing apparatus.

Moreover, since the rigid portion 209 is formed of a high-rigidity material which is not easily deformable, it prevents a situation such that the coins are elastically supported between the rigid portion 209 and the inner peripheral wall 203*a* of the connecting member 203 and hindered from falling into the holes of the disk 204, as shown FIG. 15.

While the coin dispensing operation by the rotation of the disk 204 is repeated, the coins stored in the hopper 201 are gradually reduced and those coins located above the load dispersing plate 215 slowly slide down the plate 215, thus making up for the reduction. If the bulk of the coins in the hopper 201 is temporarily increased to raise the surface level of the coins by changes of the coin distribution, contact state of the coins, the plate 215 swings upward around the rotative shaft 217, thereby preventing the increase of the load on the disk 204 positioned at the bottom of the hopper 201. Thus, it is possible to prevent an increase of the torque required for the rotation of the disk 204 or damage to the disk 204 caused by a compulsory rotation.

The load dispersing plate 215 may be fixed in a tilted position in the hopper 201 if the object of its use is only to reduce the motor torque necessary for the rotation of the disk 204 with quantities of coins in the hopper 201. In this case, however, the increase of the bulk of the coins in the region below the plate 215 is restrained by the lower surface of the plate 215 to increase the internal pressure under the plate 215, thereby subjecting the disk 204 to an excessive load. To avoid this, the load dispersing plate 215 is preferably designed for swinging motion, as in the case of the present embodiment.

If the object of use of the load dispersing plate 215 is only to bear the load from a large quantity of coins, then it is advisable to locate the plate 215 in the lower part of the hopper 201. If the height level of the load dispersing plate 215 is too low, however, the plate 215 itself may possibly prevent the coin supply to the connecting member 203, thereby forming the undesired voids or bridges. If the height level of the plate 215 is too high, on the other hand, the plate 215 fails to fulfill its function to bear the load from the coins in the hopper 201, and there is a possibility of the coins on the plate 215 running out of the hopper 201 when the plate 215 swings upward in response to the increase of the bulk in the region below the plate 215. Taking account of these circumstances, the position of the load dispersing plate 215 best suited for the shape and size of the hopper 201 as shown in FIG. 8, is set so that the vertical distance between the upper edge of the hopper 201 and the rotative shaft 217, i.e. the upper end portion of the plate 215 is substantially equal to the diameter of the coin. Although the scale is not specifically shown in FIG. 8, the size of the hopper 201 will be guessed from relationship between the size of the coin as an object of dispensation and the distance between the rotative shaft 217 and the upper edge of the hopper 201.

According to the coin dispensing apparatus of the present invention, the coins can be smoothly transported without suddenly changing their moving directions and subjecting the individual components to an impulsive force, so that the life spans of the first protrusions 114 and the guide member are improved considerably. Moreover, despite the location of the first protrusions near the outer periphery of the disk, the coins are smoothly transported along the guide member by means of vertical drags from the guide member and their associated first protrusions in a manner such that they are held under pressure between the guide member and the first protrusions. Furthermore, each coin transported to a predetermined position by its the first protrusion is further transported to the outside of the transportation limit of the first protrusion by the second protrusion which is associated with the next through hole, and is delivered securely to the coin dispensing port. Accordingly, the coins need not be compulsorily scraped out by a complex additional device, such as a scraper. Thus, the whole apparatus has a simple construction, and the coins can be securely dispensed to the last one at high speed.

Further, the coins are securely stirred by the coin stirring rod on the disk regardless of the posture of the coins, horizontal, upright, etc., whereby preventing the occurrence of bridges. The rigid portion for stirring the coins is fixed to the disk by means of the rod having a circular section in the diametrical direction thereof. Therefore, even when the coins are jammed between the rod and the inner peripheral wall of the connecting member disposed between the hopper and the base, the rotation of the rod and the rigid portion are not locked, so that the disk and the motor are prevented from being overloaded. Since the rigid portion is too rigid to be elastically deformed, such trouble can be avoided that the coins are elastically supported between the wall surface of the hopper and the rigid portion and hindered from falling into the holes of the disk 204. Furthermore, the bridge on the tip end of the rigid portion is removed by the stirring effect produced by the rotation of the V-shaped groove formed in the upper end of the rigid portion, in engagement with the coins.

What is claimed is:

1. A coin dispensing apparatus comprising:

a hopper for storing a number of coins;

a base for supporting said hopper;

a ring-shaped connecting member disposed between said hopper and said base and connected to a lower end portion of said hopper;

a disk rotatably disposed in said connecting member on said base, said disk having a plurality of through holes arranged at intervals on a circumference of one circle for catching the coins fed from the hopper, first and second protrusions arranged on either side of each through hole and a column formed in a central portion of said disk, said disk rotating in the direction from said first protusion to said second protrusion;

said first and second protrusions and said column being formed on a surface of said disk facing said base, said first protrusion being positioned in the vicinty of an outer peripheral edge of said disk, the second protusion being positioned a little closer to the outer peripheral edge of said disk than the first protrusion;

a guide member provided on said base so as to extend along a rotating direction of said disk and having an abutment surface abutting the coins and a length shorter than the distance from an outer peripheral surface of said column to said first protrusion, said engaging surface extending along a tangent to the outer peripheral surface of said column from a position near the outer peripheral surface;

said connecting member having an opening in a peripheral wall thereof with a length greater than the diameter of each coin in the direction opposite to the rotating direction of said disk from a position on an extension of the abutment surface of said guide member, said base having a coin dispensing port bored therein along said opening;

whereby a coin dropped onto said base through said through hole of said disk is transported under pressure by said first protrusion in a manner such that the path of the coin is regulated by said second protrusion, the inner peripheral surface of said connecting member and the outer peripheral surface of said column, abuts against the guide member to change the course thereof and is guided into said coin dispensing port; and a coin stirring rod projecting from an upper surface of said disk along an axis of rotation of said disk, said coin stirring rod including a rod with a circular diametrical cross section, fixed to said disk and projecting above an upper edge of said connection member, and a rigid portion fixed to a tip end of said rod and having a non-circular diametrical cross section with a diameter greater than that of said rod.

2. A coin dispensing apparatus according to claim 1, wherein said first protrusion is situated in the direction opposite to the rotating direction of the disk with respect to the associated through hole, and said second protrusion is situated in the rotating direction of said disk with respect to the associated through hole.

3. A coin dispensing apparatus according to claim 1, wherein said base includes a guide piece having an edge portion extending along the extension of said abutment surface of said guide member so that the coins rolling along said abutment surface of said guide member are guided into said coin dispensing port by said edge portion.

4. A coin dispensing apparatus including a hopper for storing a number of coins, a base for supporting said hopper, a connecting member disposed between said hopper and said base, and a disk rotatably disposed in said connecting member and having a plurality of through holes for catching coins, in which the coins caught by said through holes are transported and guided into a coin dispensing port as said disk rotates, wherein said coin dispensing apparatus further including:

a coin stirring rod projecting from an upper surface of said disk along an axis of rotation of said disk, said stirring rod including a rod with a circular diametrical cross-sectional contour, fixed to said disk and projecting above an upper edge of said connecting member, and a rigid portion fixed to a tip of said rod and having a non-circular diametrical cross-section with a diameter greater than that of said rod and wherein the diametrical cross-sectional contour of said rigid portion is elliptic.

5. A coin dispensing apparatus according to claim 4, wherein an upper end face of said rigid portion has a V-shaped groove extending along the minor axis of a ellipse constituting the cross-sectional contour.

* * * * *